US005088613A

United States Patent [19]

Dutt et al.

[11] Patent Number: 5,088,613

[45] Date of Patent: Feb. 18, 1992

[54] TAMPER EVIDENT CLOSURE

[75] Inventors: Herbert V. Dutt, Venetia; Thomas F. Hudak, Bethel Park, both of Pa.

[73] Assignee: Continental Plastics, Inc., Triadelphia, W. Va.

[21] Appl. No.: 660,640

[22] Filed: Feb. 25, 1991

[51] Int. Cl.[5] ..... B65D 47/10; B65D 41/32

[52] U.S. Cl. ..... 215/250; 215/252; 215/256; 222/521; 222/541

[58] Field of Search ..... 215/250, 252, 253, 254, 215/255, 256, 258; 222/519, 520, 521, 541

[56] References Cited

U.S. PATENT DOCUMENTS

| | | | |
|---|---|---|---|
| 3,180,532 | 4/1965 | Michel | 222/541 X |
| 3,407,967 | 10/1968 | Stull | 222/521 X |
| 3,591,031 | 7/1971 | Komendowski | 215/250 |
| 3,635,724 | 1/1972 | Schaar | 215/250 X |
| 3,967,745 | 7/1976 | Julian | 215/216 |
| 4,546,893 | 10/1985 | Stull | 215/252 |
| 4,570,825 | 2/1986 | Stull | 222/521 X |
| 4,709,823 | 12/1987 | Beck et al. | 215/235 |
| 4,760,941 | 8/1988 | Salmon et al. | 215/256 X |
| 4,773,551 | 9/1988 | Rizzardi | 215/253 |
| 4,821,897 | 4/1989 | Weiler | 215/253 X |

*Primary Examiner*—Stephen Marcus
*Assistant Examiner*—Vanessas Caretto
*Attorney, Agent, or Firm*—Richard V. Westerhoff

[57] ABSTRACT

A tamper evident closure integrally molded in a straight draw mold without slides or cams has a cap skirt, a tamper band radially spaced from the free end of the skirt and extending radially outward, and an anchoring member, spaced radially outward of the tamper band. The tamper band is connected to both the cap skirt and the anchoring member by tearable connections in the form of scored membranes, or preferably, discrete circumferentially spaced radially extending frangible bridges. The tamper band has a circumferentially extending gap and an integral pull tab extending radially outward from one end through a gap in the anchoring member. Preferably, the scored membranes or the frangible bridges between the tamper band and the cap skirt adjacent one end of the tamper band and between the tamper band and the anchoring member at the other end are greater in cross-section than the remainder of the tearable connections so that any attempt to unscrew the closure without tearing out the tamper band results in irreversible distortion and even fracture of the tamper band.

23 Claims, 3 Drawing Sheets

TAMPER EVIDENT CLOSURE

BACKGROUND OF THE INVENTION

1. Field of the Invention

This invention is directed to a container closure which provides a visual indication that the closure has been opened or tampered with. More particularly, it relates to a tamper evident closure having a tear band which must be torn from both a skirt of the closure and an anchor band permanently secured to a shoulder on the container to which the closure is applied in order to remove the closure from the container.

2. Background Information

There is a growing demand today for container closures, especially for food and medicines, which provide a visual indication if the container has been opened or tampered with in any way. Some of these tamper evident closures include a tear band with prevents removal of the closure until the tear band has been irreversibly severed from the closure cap. In the closure disclosed in U.S. Pat. No. 3,407,957, the tear band is defined by a pair axially spaced annular score lines in an extension of the cylindrical skirt of the closure. The cylindrical section below the tear band is permanently secured to the container neck, and has a flange which extends radially outward further than a pull tab molded to the tear band. Such closures require molds with slides or cams, or post molding operations to form the undercut surfaces and radially extending score lines. This increases the complexity and cost of manufacturing such closures.

There remains a need therefor for a tamper evident closure with provides a clear, reliable indication of previous removal or tampering yet can be produced in a straight draw mold without cams or slides.

There is a further need for such a tamper evident closure which is so distorted in removal that it cannot be replaced without providing an easily recognized indication that it has been removed.

Another difficulty with some tamper evident closures is that they do not provide a clear visual indication of tampering. If the closure is carefully removed and replaced, the fractures cannot be detected without very close scrutiny.

SUMMARY OF THE INVENTION

These and other needs are satisfied by the invention which is directed to a molded container closure which has a cap with a skirt, a tear band extending radially outward, but spaced from a free edge of the cap skirt, and an anchoring member spaced radially outward from the tamper band. The anchoring member is permanently secured, such as by sonic welding, to a radial shoulder on a container to which the closure is applied. The tear band is connected to the free edge of the skirt and to the anchoring member by tearable connections such as scored membranes, but preferably by a number of circumferentially spaced radially extending frangible bridges. Preferably, the tear band has a circumferential gap and a pull tab adjacent one end by which the tear band can be grasped and pulled to sever the tearable connections to both the cap skirt and the anchoring member.

Preferably, the tearable connections, such as the scored membranes or frangible bridges, between the cap skirt and one end of the tear band, and between the anchoring member and the other end of the tear band are greater in cross-section than along the remainder of the tear band. This is especially useful on a closure which must be unscrewed to remove it from the container, as these stronger connections at opposite ends of the tear band remain attached after the connections along the remainder of the tear band have been severed resulting in a permanent distortion, or possibly even fracture, of the tear band which prevent any attempt to reapply the closure with the tamper band in place.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
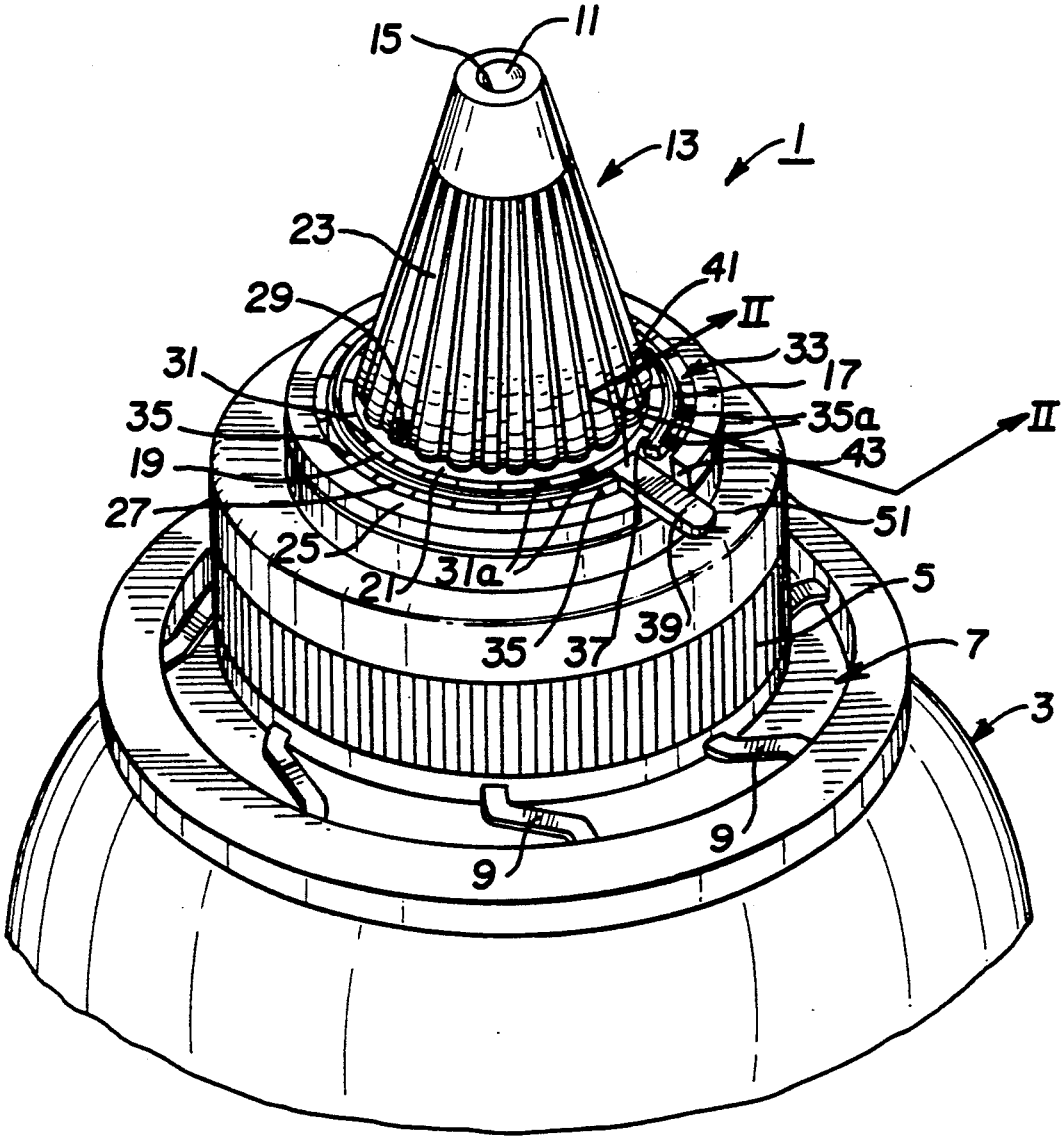
FIG. 1 is an isometric view of a tamper evident closure in accordance with the invention shown applied to a twist type spout closure.
Figure 2:
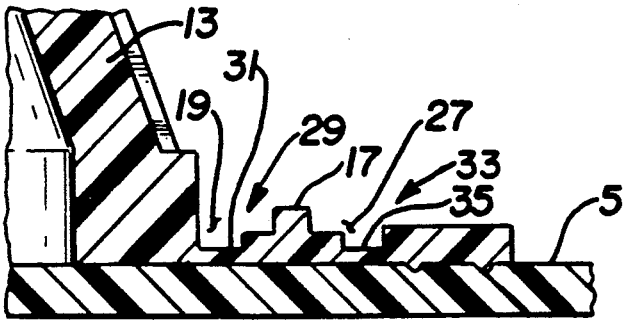
FIG. 2 is a fragmentary vertical section in enlarged scale taken along the line II—II in FIG. 1.
Figure 3:
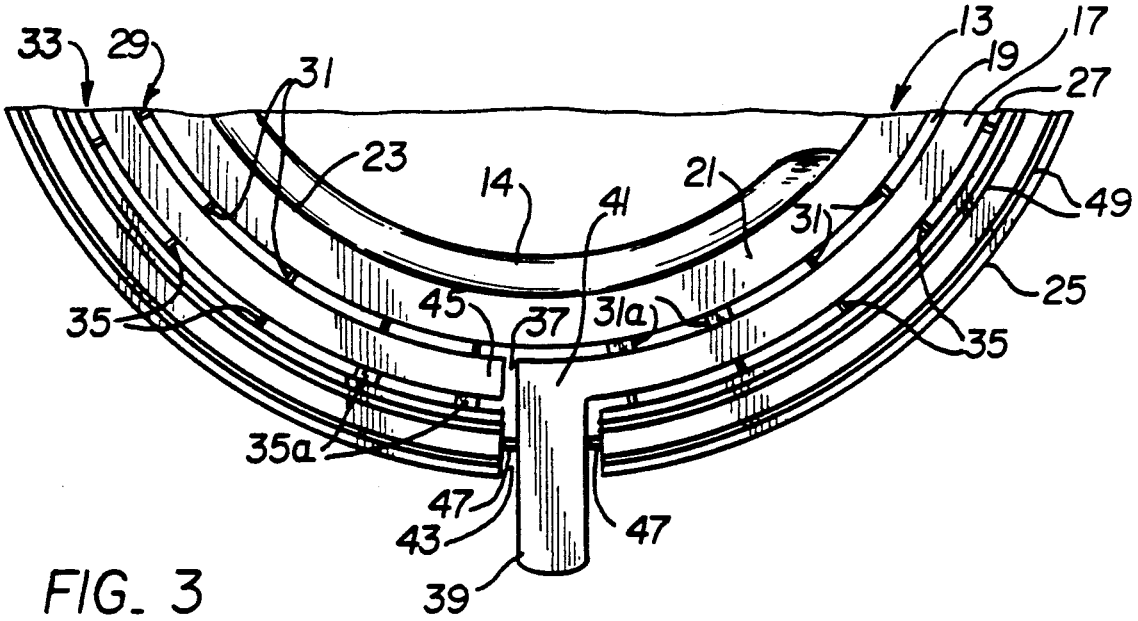
FIG. 3 is a fragmentary bottom view of a closure in accordance with the embodiment of FIGS. 1 and 2.

Referring to FIGS. 1–3, the invention is shown as incorporated into a twist type spout cap 1 applied to a squeezable container 3. The spout cap 1 is well known and includes a base 5 which screws onto the container 3. For the purpose of describing the closure of the present invention, the base 5 will be considered as being part of the container. In fact, as shown, the base 5 is secured to the container with a tamper evident connection 7 of the type shown in U.S. Pat. No. 4,844,272 so that if the base is ever removed from the container, the frangible S-shaped bridges 9 will be fractured to provide a visual warning that this has occurred.

The spout cap 1 includes a central axially extending member 11 and a tapered cap 13 with an internal thread 14 and an aperture 15 at the upper end which provides an opening for dispensing the contents of the container when the cap is twisted to extend it axially relative to the member 11. This opening is closed by the member 11 when the cap is twisted in the opposite direction.

The invention provides a tamper evident feature for this twist type spout cap 1, and includes a tear band 17 radially spaced by an annular gap 19 from the free edge 21 of the skirt 23 of the cap 13. An annular anchoring member 25 is spaced radially outward from the tear band 17 by another annular gap 27. The tamper band 17 is connected to the free edge 21 of the skirt 23 by a first tearable connection 29 in the form of a number of circumferentially spaced, radially extending, frangible bridges 31. Similarly, the tear band 17 is connected to the anchoring member 25 by a second tearable connection 33 in the form of the circumferentially spaced, radially extending frangible bridges 35.

The tear band 17 is interrupted by a circumferential gap 37. An integral pull tab 39 extends radially outward from one end 41 of the pull tab through a corresponding gap 43 in the anchoring member 25. As seen more clearly in the fragmentary bottom view of FIG. 3, the first or a few of the bridges 31*a* adjacent the pull tab 39 at the one end 41 of the tamper band 17 are greater in cross section than the adjacent bridges 31 between the tamper band 17 and the skirt 23 of the cap 13, and the bridges 35 between the tear band 17 and the anchor ring 25. At the other end 45 of the tamper band 17, a first one or few of the bridges 35*a* are greater in cross section than either the adjacent bridges 35 or the bridges 31. As can be seen from FIG. 3, there are additional frangible bridges 47 extending circumferentially between the pull tab 39 and ends of the anchor ring 25 at the gap 43. These addition bridges 47 help to prevent premature separation of the tear band during shipment and storage.

As can also be seen from FIG. 3, a pair of annular ribs 49 are provided on the bottom surface of the anchor ring 25. These ribs 49 serve as energy concentrators for sonically welding the anchor ring 25 to the container.

The cap 13 can be integrally molded with the tear band 17 and its pull tab 39 connected to the cap skirt 13 by bridges 31, and to the anchor ring 25 by the bridges 35 in a straight mold without the need for any cams or shims as there are no undercuts in the cap. The cap 13 is applied to the container, in this case the base 5 of the twist-type spout closure 1, and the anchor ring 25 is sonically welded or otherwise secured to the shoulder 51 formed by the base 5. In order to dispense the contents from the container 3, the pull tab 39 is grasped and pulled upward. This fractures the bridges 47. There are no bridges 31 adjacent the pull tab 39 so that continued upward movement of the pull tab provides leverage to fracture the bridges 31 and 35 successively along the full length of the pull tab to completely separate the pull tab from both the anchor member 25 and the tapered cap 13. Once the tear band 17 has been removed, the tapered cap 13 can be twisted to open the spout for dispensing of the container contents. The spout is closed by twisting the cap in the opposite direction. Removal of the tear band 17 provides a visual indication that the container has been opened, or at least tampered with. The tear band cannot be replaced.

If, instead of removing the tear band by pulling on the tab 39, the tapered cap 13 is merely twisted in the opening direction, there is a remote possibility that one of the sets of bridges 31 or 35 could be fractured while the others remained intact, so that the tear band would remain connected to either the cap 13 or the anchor ring 25. If the cap were then returned to the closed position, the tamper band would remain in place, and a casual glance may not reveal that the closure has been opened or tampered with.

Figure 4:
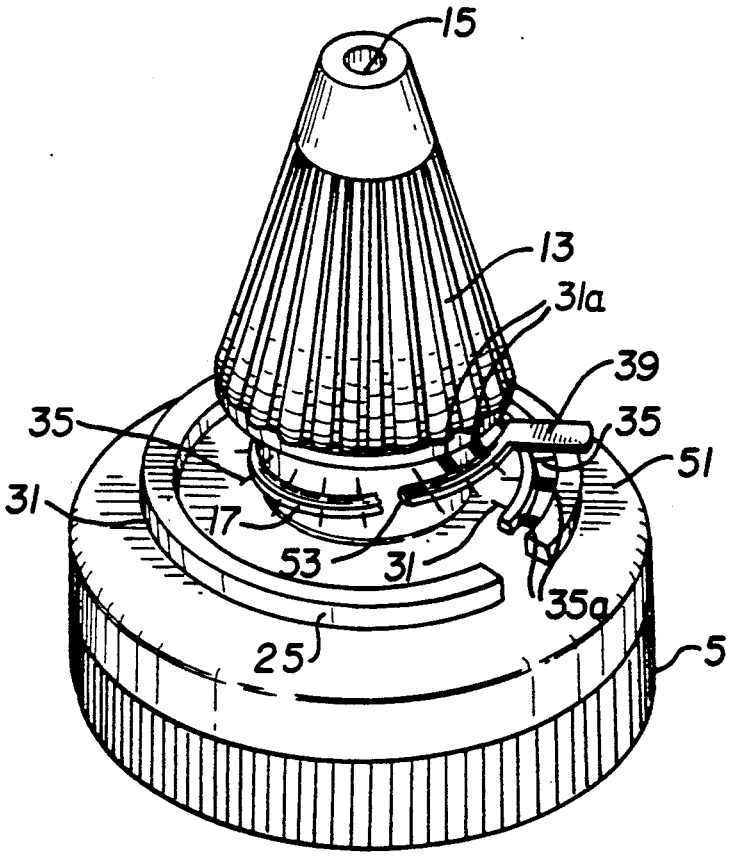
FIG. 4 illustrates the effect of an attempt to unscrew the closure of FIGS. 1–3 without first removing the tear band.
Figure 5:
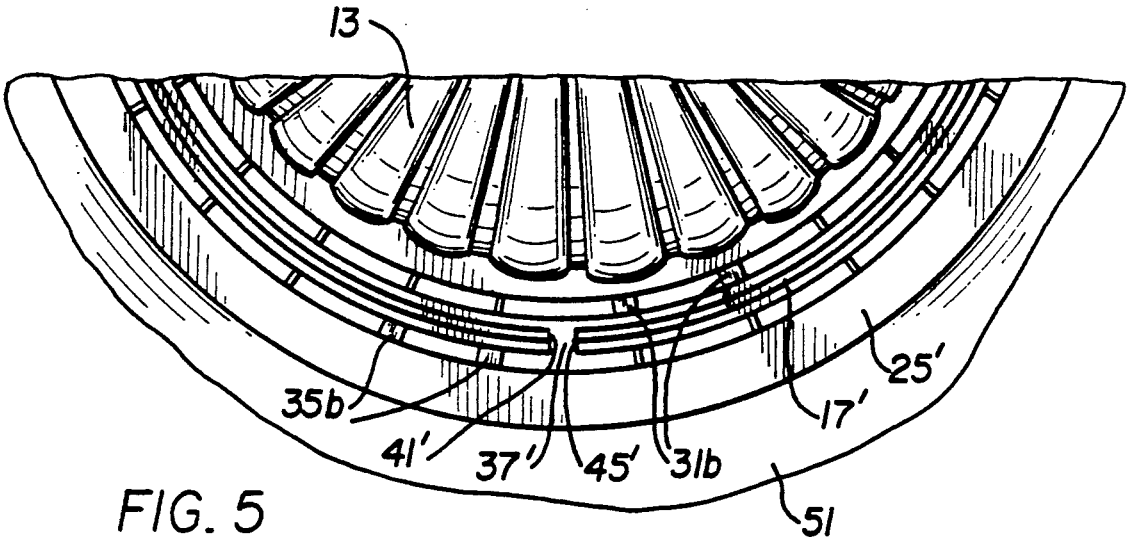
FIG. 5 is a fragmentary bottom view of a modification to the closure of FIGS. 1–4.

In accordance with a further aspect of the invention, the bridges between the tamper band and the cap at one end of the tamper band, and between the tamper band and the anchor ring at the other end, are made stronger so that they resist fracturing if the cap is unscrewed. Thus, on the closure shown in FIGS. 1–3, the bridges 31A between the tear band 17 and the cap adjacent the one end 41, which is the leading end of the tamper band as the cap is unscrewed, and the anchor ring 25 adjacent the other end 45 of the tear band, which is the trailing end during unscrewing of the cap are made greater in cross section than the remaining bridges 31 and 35. The greater cross section of these bridges is realized by making them wider circumferentially while maintaining the same thickness as the remaining bridges. Now, when the cap is unscrewed, the bridges 31 and 35 fracture while the bridges 31A and 35A remain intact. This places the tear band 17 in tension which elongates it and distorts it out of shape, and may even fracture it as shown at 53 in FIG. 4, so that if the cap is screwed down again, the distorted tear band 17 will not neatly realign between the cap skirt 23 and the anchor ring 25, thus, providing an indication that the closure has been tampered with. As the bridges 31A and 35A are the same thickness as the remaining bridges, they will readily tear when the tamper band is peeled off by lifting on the pull tab 39 in the normal manner. Alternatively, one or a few of the bridges 35*b* adjacent the leading end 41′ of the tamper band as the cap is unscrewed and the bridges 31*b* adjacent the trailing end 45′ can be made wider as shown in FIG. 5, so that if the cap is unscrewed without removing the tear band, the tear band is placed in compression. This also distorts the tear band so that if the cap is screwed back down, the tear band will remain distorted and will not resume it molded position. As also shown in the embodiment shown in FIG. 5, the tear band 17′ is not provided with a pull tab, and hence the anchor ring 25′ need not be provided with a gap. In this configuration, the bridges 31 and 35 fracture initially when the cap is twisted open and then the thicker bridges 31*b* and 35*b* are broken to remove the tear band. In either configuration, with or without the pull tab, the thicker bridges 31*a*, 35*a* or 31*b*, 35*b* can be used.

Figure 6:
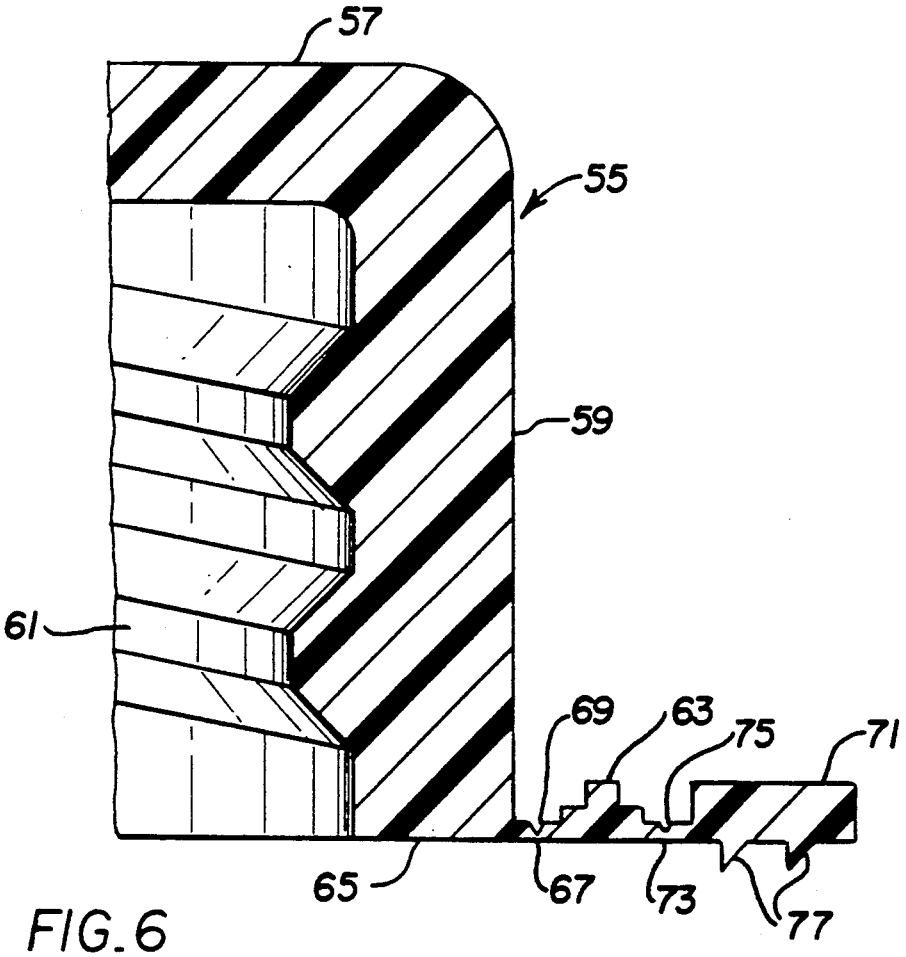
FIG. 6 is a fragmentary vertical section through another embodiment of a closure in accordance with the invention.

Another embodiment of a closure in accordance with the invention is illustrated in FIG. 6. This closure includes a screw cap 55 having an end wall 57 and a cylindrical skirt 59 with an internal thread 61. In this closure, the tear band 63 is connected to the free end 65 of the skirt 59 by a thin membrane 67 having a score line 69. The tamper band 63 is also connected to an anchor ring 71 radially outward of the tamper band 63 by another thin membrane 73 having a score line 75. This anchor ring 71 is also provided with energy concentrating ribs 77 for sonically welding the anchor ring 71 to a shoulder on a container. When the tear band 63 is pulled upward, the membranes 67 and 73 tear along the score line 69 and 75, respectively. The tearable connections for the tear band can be made greater in cross section at the locations indicated in connection with the closure shown in FIGS. 1–4, for instance by reducing the depth of the score line in the designated areas. Thus, as shown in FIG. 6, the score line 75 does not penetrate to as great a depth as the score line 69 so that in the section shown, the tear band will remain secured to the anchor ring 71 if an attempt is made to unscrew the cap without removing the tear band. This again will result in distortion of the tear band so that the cap cannot be replaced without a visual indication of the tampering.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A tamper evident closure for a container having an axially extending member defining a container opening and a shoulder extending generally radially outward from a base of said axially extending member, said closure comprising:

a skirt extending around and generally axially along said axially extending member of said container and terminating in a free edge adjacent said shoulder on the container;

a generally radially extending tear band extending substantially around and spaced radially outward from said free edge of said skirt;

a generally radially extending anchoring member extending substantially around and spaced radially outward from said tear band, said anchoring member being permanently secured to the shoulder of said container;

first tearable connecting means extending radially between said free edge of said skirt and said tear band; and second tearable connecting means extending radially between said tear band and said anchoring member; and a pull tab secured to said tear band through which a force is applied to the tear band to tear said first and second tearable connecting means and thereby separate the tear band from both the skirt of said closure and said anchoring member secured to the container shoulder to free said closure for removal from the container.

2. The tamper evident closure of claim 1 wherein said tear band has a gap therethrough defining first and second ends of said tear band, and wherein said pull tab is secured adjacent the first end of said tear band.

3. The tamper evident closure of claim 2 wherein said first tearable connecting means between the free edge of said skirt and the tear band is greater in cross-section adjacent one end of the tear band than along a remainder of said tear band, and wherein the second tearable connecting means between the tear band and the radially outward anchoring member is greater in cross-section adjacent the other end of said tear band than along a remainder of said tear band.

4. The tamper evident closure of claim 3 wherein said one end of said tamper band is said first end.

5. The tamper evident closure of claim 4 wherein said first and second tearable connecting means are discrete generally radially extending circumferentially spaced frangible bridges.

6. The tamper evident closure of claim 4 wherein said first and second tearable connecting means are membranes with score lines.

7. The tamper evident closure of claim 3 wherein said one end of said tear band is said second end.

8. The tamper evident closure of claim 7 wherein said first and second tearable connecting means are discrete generally radially extending circumferentially spaced frangible bridges.

9. The tamper evident closure of claim 7 wherein said first and second tearable connecting means are membranes with score lines.

10. The tamper evident closure of claim 3 wherein said anchoring member has a circumferential gap extending therethrough, and wherein said pull tab is integral with and extends radially outward from the tear band through said circumferential gap in said anchoring member.

11. The tamper evident closure of claim 10 including additional frangible bridges extending generally circumferentially between said pull tab and said anchoring member at said gap in said anchoring member.

12. The tamper evident closure of claim 1 wherein said first and second tearable connecting means comprise generally radially extending frangible bridges.

13. The tamper evident closure of claim 1 wherein said first and second connecting means comprise membranes with score lines.

14. The closure of claim 1 wherein said anchor member has a gap and wherein said pull tab extends generally radially outward through said gap in said anchor member.

15. The tamper evident closure of claim 14 including additional tearable connecting means connecting said pull tab to said anchoring member across said gap in said anchoring member.

16. In combination:

a container having an axially extending member defining a container opening and a shoulder extending generally radially outward from a base of said axially extending member; and a closure comprising:

a skirt extending around and generally axially along said axially extending member of said container and terminating in a free edge adjacent said shoulder on the container;

a generally radially extending tear band extending substantially around and spaced radially outward from said free edge of said skirt;

a generally radially extending anchoring member extending substantially around and spaced radially outward from said tear band, said anchoring member being permanently secured to the shoulder of said container;

a first set of generally radially extending circumferentially spaced frangible bridges between said free edge of said skirt and said tear band;

a second set of generally radially extending circumferentially spaced frangible bridges between said tear band and said anchoring member; and a pull tab secured to said tear band through which a force is applied to the tear band to tear said first and second sets of frangible bridges and thereby separate the tear band from both the skirt of said closure and said anchoring member secured to the container shoulder to free said closure for removal from said container.

17. The combination of claim 16 wherein said tear band of said closure has a gap therethrough defining first and second ends of said tear band with said pull tab being secured adjacent the first end of said tear band, and wherein at least one of the frangible bridges of said first set of frangible bridges adjacent one end of said tear band is greater in cross-section than the remainder of said first set of frangible bridges, and wherein at least one of the frangible bridges of said second set of frangible bridges adjacent the other end of said tear band is greater in cross-section than the remainder of said second set of frangible bridges.

18. The combination of claim 17 wherein said skirt on said closure has screw threads, wherein said first end of said tear band is a leading end of said tear band as said closure is unscrewed from said container, and wherein said one end of said tear band is said first end.

19. The combination of claim 17 wherein said skirt on said closure has screw threads, wherein said first end of said tear band is a leading end of said tear band as said closure is unscrewed from said container, and wherein said one end of said tear band is said second end.

20. A tamper evident closure for a container having an axially extending member defining a container opening and a shoulder extending generally radially outward from a base of said axially extending member, said closure comprising:

a skirt extending around and generally axially along said axially extending member of said container and terminating in a free edge adjacent said shoulder;

a generally radially extending tear band extending substantially around and spaced radially outward from said free edge of said skirt, and having a gap therein forming a first and a second end on said tear band;

a generally radially extending anchoring member extending substantially around and spaced radially outward from said tear band, said anchoring member being permanently secured to said shoulder;

first tearable connecting means extending radially between said free edge of said skirt and said tear band; and second tearable connecting means extending radially between said tear band and said anchoring member.

21. A tamper evident closure of claim 20 wherein said first tearable connecting means between the free edge of said skirt and a tear band is greater in cross-section adjacent one end of the tear band than along a remainder of the tear band and wherein the second tearable connecting means between the tear band and the radially outward anchoring member is greater in cross-section adjacent the other end of said tear band along a remainder of said tear band.

22. The tamper evident closure of claim 21 wherein said skirt is provided with an internal thread by which said skirt is rotated to open and close the container opening, and wherein said one end of said tear band leads as said cap is rotated to open said container.

23. The tamper evident closure of claim 21 wherein said skirt is provided with an internal thread by which said skirt is rotated to open and close said container opening, and wherein said other end of said tear band leads as said cap is rotated to open said container opening.

* * * * *